United States Patent [19]

Sumikawa et al.

[11] Patent Number: 4,867,458

[45] Date of Patent: Sep. 19, 1989

[54] GOLF CLUB HEAD

[75] Inventors: Noburoh Sumikawa; Masaki Fujimura, both of Hamamatsu, Japan

[73] Assignee: Yamaha Corporation, Japan

[21] Appl. No.: 218,682

[22] Filed: Jul. 13, 1988

[30] Foreign Application Priority Data

Jul. 17, 1987 [JP] Japan ..... 62-110386[U]

[51] Int. Cl.[4] ..... A63B 53/04

[52] U.S. Cl. ..... 273/171; 273/167 H

[58] Field of Search ..... 273/171, 167 F, 167 H, 273/169, 170, 172, 167 A

[56] References Cited

U.S. PATENT DOCUMENTS

| | | | |
|---|---|---|---|
| 2,517,245 | 8/1950 | Scott | 273/171 |
| 3,466,047 | 9/1969 | Rodia et al. | 273/171 |
| 3,556,533 | 1/1971 | Hollis | 273/171 |
| 3,652,094 | 3/1972 | Glover | 273/171 |
| 4,423,874 | 1/1984 | Stuff | 273/171 |
| 4,754,977 | 7/1988 | Sahm | 273/171 |

FOREIGN PATENT DOCUMENTS

| | | | |
|---|---|---|---|
| 439187 | 12/1935 | United Kingdom | 273/171 |
| 2133295 | 7/1984 | United Kingdom | 273/171 |

*Primary Examiner*—George J. Marlo

*Attorney, Agent, or Firm*—Lerner, David, Littenberg, Krumholz & Mentlik

[57] ABSTRACT

A golf club head including a sole, a back and a face, and a plurality of adjuster pins at least two of which are different in weight, degree of insertion and/or diameter, are inserted into the sole of a wood club head or the back of an iron club head at selected positions on an imaginary arcuate line taken on the sole or back of the head. By selecting the number of the adjuster pins, the combination of the adjuster pins and/or position of the adjuster pins, the center of gravity of the head main body can be three dimensionally changed to provide a wide variety of adjustment in weight.

7 Claims, 1 Drawing Sheet

GOLF CLUB HEAD

BACKGROUND OF THE INVENTION

The present invention relates to an improved golf club head, and more particularly relates to improvement in weight balance and inertia adjustment of a wood or iron club head.

Different expedients are employed in construction of conventional wood and iron club heads for weight balance and inertia adjustment, i.e. adjustment in position of the center of gravity. In the case of a wood club head having an FRP (fiber reinforced plastics) shell, a threaded hole is formed in the sole of the head main body and adjuster pins of different lengths and/or weights are selectively screwed into the thread hole. Whereas in the case of an iron club head, several adjuster pins are screwed in the back of the head main body in a direction parallel to the sole and side by side in the toe-heel direction.

In the case of the wood club head, use of only one adjuster does not allow a wide variety of free weight balance and intertia adjustment despite the possibility of change in length and/or weight. In the case of the iron club head, arrangement of the adjuster pins parallel to the sole disenables free adjustment in weight balance and inertia with respect to the sole.

SUMMARY OF THE INVENTION

It is the basic object of the present invention to provide a golf club head which allows a wide variety of free and easy weight balance and inertia adjustment.

It is another object of the present invention to provide a golf club head which enables free adjustment in weight balance and inertia with respect to the sole.

In accordance with the basic aspect of the present invention, a plurality of adjuster pins are inserted into one of the sole and the back of the head main body at positions on a common arcuate line off the face and at least two of the adjuster pins are different in at least one of weight, length and diameter.

DESCRIPTION OF THE PREFERRED EMBODIMENTS

Figure 1:
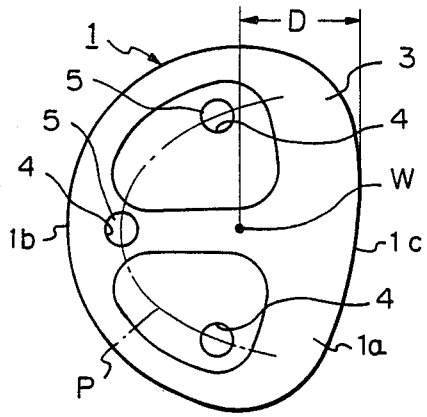
FIG.1 is a bottom plan view of a wood club head as the first embodiment of the golf club head in accordance with the present invention.
Figure 2:
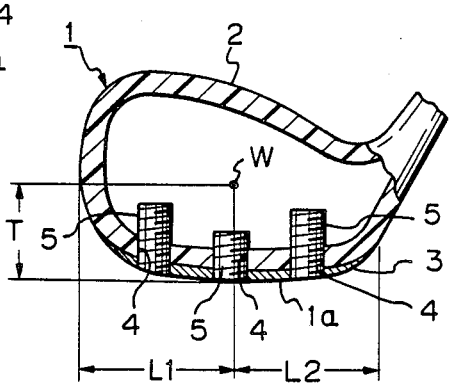
FIG.2 is a sectional front plan view of the wood club head.

One embodiment of the golf club head in accordance with the present invention is shown in FIGS. 1 and 2 in the form of a wood club head. In the case of the illustrated example, the head main body 1 has a cavitious construction formed with an FRP shell 2. As a substitute, the head main body 1 may have a solid construction including the FRP shell 2 embracing foam resin core. The head main body 1 is accompanied with a sole plate 3 coextensive with its sole 1*a*. This sole plate 3 is generally made of metal such as brass or A alloys and attached to the head main body 1 for protection of the sole and adjustment in total weight. A plurality of, three in the illustrated example, threaded holes 4 are formed in the sole 1*a* along the back 1*b* at positions on a common arcuate line P drawn around the face 1*c* as shown with a chain line in the illustration. As clearly seen in FIG. 2, adjuster pins 5 are screwed into the threaded holes 4. At least two of the adjuster pins 5 are different in at least one of weight, length and diameter. In the case of the illustrated example, one adjuster pin is different in length from two other adjuster pins. By properly changing the position and/or the type of the adjuster pins 5, the position of the center of gravity can be selectively adjuster as desired. As well seen in the drawings, this position is defined three-dimensionally by the height T from the sole 1*a*, the depth D from the face 1*c*, and distances L1 and L2 from the toe and heel of the head main body 1.

Figure 3:
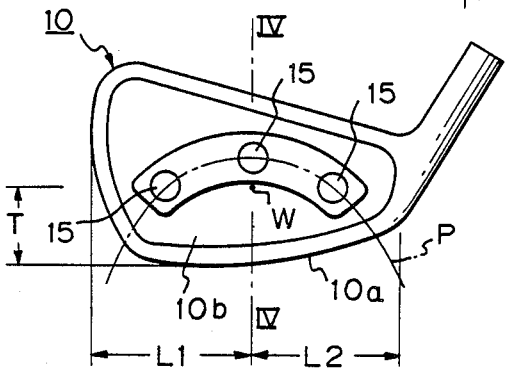
FIG.3 is a back plan view of an iron club head as the second embodiment of the golf club head in accordance with the present invention.
Figure 4:
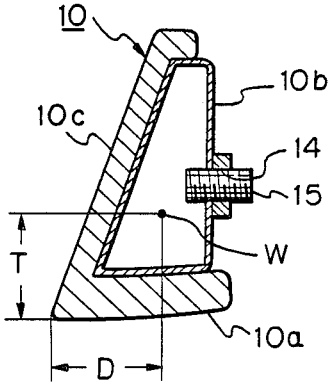
FIG.4 is a section taken along the line IV—IV in FIG. 3.

Another embodiment of the golf club head in accordance with the present invention is shown in FIGS. 3 and 4 in the form of an iron club head. A plurality of, three in the illustrated example, threaded holes 14 are formed in the back 10*b* of the head main body 10 at positions on a common arcuate line P as shown with a chain line P and adjuster pins 15 are screwed into the threaded holes 4 while extending towards the face 10*c* substantially in parallel to the sole 11*a*. Like the foregoing embodiments, at least two of the adjuster pins 15 are different in at least one of weight, length and diameter.

The adjuster pins are preferably made of Al, brass, stainless steel and Tn. The diameter of the adjuster pins are preferably be in range from 6 to 12 mm. Three to five, more preferably three to four adjuster pins are used for weight balance adjustment in a range from 3 to 30g.

We claim:

1. An improved golf club head comprising a club head body having a sole, a back and a ball striking face, and at least three adjuster pins inserted into apertures in said club head body, said adjuster pins and apertures located along an imaginary arcuate line provided on a surface of the club head other than said ball striking face, said imaginary arcuate line having a radius of curvature wherein an imaginary straight line passing through the first and last adjuster pin positioned on said imaginary arcuate line passes by and does not intersect any other adjuster pin positioned on said imaginary arcuate line, all of the adjuster pins and apertures in said surface not positioned on said imaginary straight line being positioned on the same side thereof.

2. An improved golf club head as claimed in claim 1, wherein at least two of said adjuster pins are different in at least one of weight, degree of insertion and diameter.

3. An improved golf club head as claimed in claim 2, in which said adjuster pins permit change in the position of the center of gravity of the club head body in three dimensions.

4. An improved golf club head as claimed in claim 1 in which said golf club head takes the form of a wood club head, and said adjuster pins are inserted into said sole.

5. An improved golf club head as claimed in claim 1 in which said golf club head takes the form of an iron club head, and said adjuster pins are inserted into said back.

6. An improved golf club head as claimed in one of claims 4, 5 or 1 in which said diameter of said adjuster pins are in a range from 6 to 12 mm.

7. An improved golf club head as claimed in one of claims 4, 5 or 1 in which four to five adjuster pins are used.

* * * * *

UNITED STATES PATENT AND TRADEMARK OFFICE

CERTIFICATE OF CORRECTION

PATENT NO. : 4,867,458

DATED : September 19, 1989

INVENTOR(S) : Sumikawa et al.

It is certified that error appears in the above-identified patent and that said Letters Patent is hereby corrected as shown below:

Title page:

In the Abstract, last line, after "weight", insert --balance and inertia of the club head--.

Signed and Sealed this

Twenty-fifth Day of December, 1990

*Attest:*

HARRY F. MANBECK, JR.

*Attesting Officer*

*Commissioner of Patents and Trademarks*